US006695226B1

(12) United States Patent
Stern

(10) Patent No.: US 6,695,226 B1
(45) Date of Patent: Feb. 24, 2004

(54) DEVICE FOR RELEASABLY ATTACHING AND STORING A FOCUSING STRAW ONTO AN AEROSOL CAN

(76) Inventor: Roger Louis Stern, 3578 W. Nestled Desert Pl., Tucson, AZ (US) 85742

( * ) Notice: Subject to any disclaimer, the term of this patent is extended or adjusted under 35 U.S.C. 154(b) by 0 days.

(21) Appl. No.: 10/190,237

(22) Filed: Jul. 5, 2002

(51) Int. Cl.[7] ..... A62C 11/00

(52) U.S. Cl. ..... 239/333; 222/538; 24/326; 220/735; 248/213.2

(58) Field of Search ..... 239/333, 33, 337, 239/390, 391, 397; 222/538, 536; 24/17 AP, 17 B, 16 R, 304, 326, 270; 220/710, 669, 671, 694, 735; 248/213.2, 499; 604/179, 180

(56) References Cited

U.S. PATENT DOCUMENTS 3,059,645 A * 10/1962 Hasbrouck et al. ..... 24/16 PB
4,280,258 A * 7/1981 Kunze ..... 24/16
4,819,838 A * 4/1989 Hart, Jr. ..... 239/337
4,823,445 A * 4/1989 Diener ..... 24/326
5,544,783 A * 8/1996 Conigliaro ..... 220/735
5,558,247 A * 9/1996 Caso ..... 248/316.7
5,988,575 A * 11/1999 Lesko ..... 248/213.2
5,992,678 A * 11/1999 Willey ..... 220/735
D441,652 S * 5/2001 Valentine, Jr. ..... D9/434
6,315,152 B1 * 11/2001 Kalisz ..... 220/735

OTHER PUBLICATIONS

WD–40 Web Site, wd40.com, What's New, 2 pages, on p. 2 Hold it Right There, Jul. 4, 2002.

* cited by examiner

*Primary Examiner*—Dinh Q. Nguyen
(74) *Attorney, Agent, or Firm*—John R. Daugherty

(57) ABSTRACT

A device providing an improved method for the storage and releasable attachment of a focusing straw onto an aerosol can. In a preferred embodiment, the device is a commercially available cable-tie, modified to provide a releasable attachment and reliable storage of a focusing straw onto an aerosol can. A method of the present invention allows a user to modify an existing cable-tie to provide releasable attachment of a focusing straw onto an aerosol can or other item. The availability and subsequent use of a focusing straw often reduces aerosol over-spray and the resultant air borne contamination. Use of the present invention has, in some cases, reduced the consumption of aerosol spray oil by 30%.

5 Claims, 10 Drawing Sheets

FIG. 2A
Prior Art
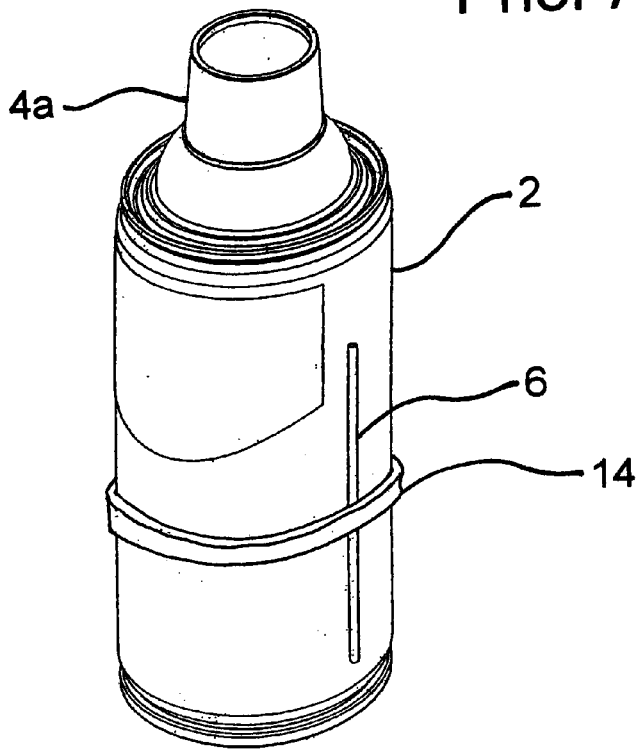
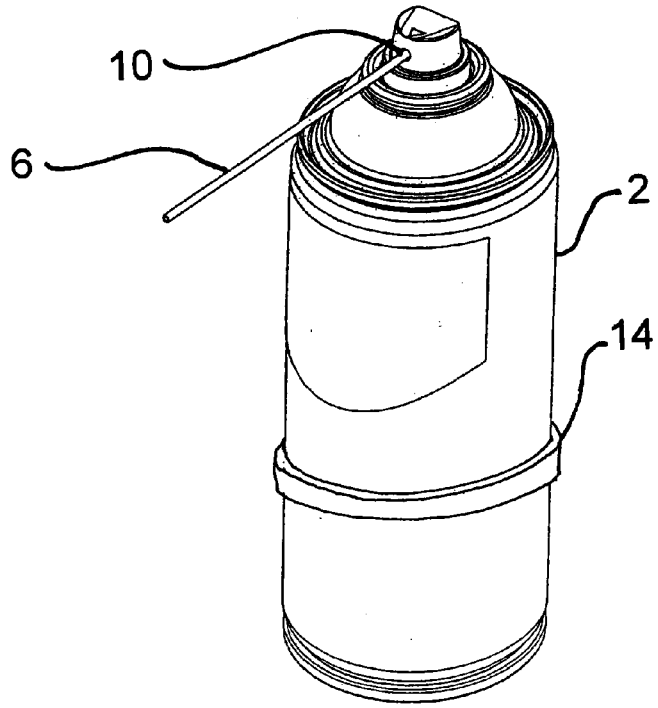
FIG. 2B
Prior Art

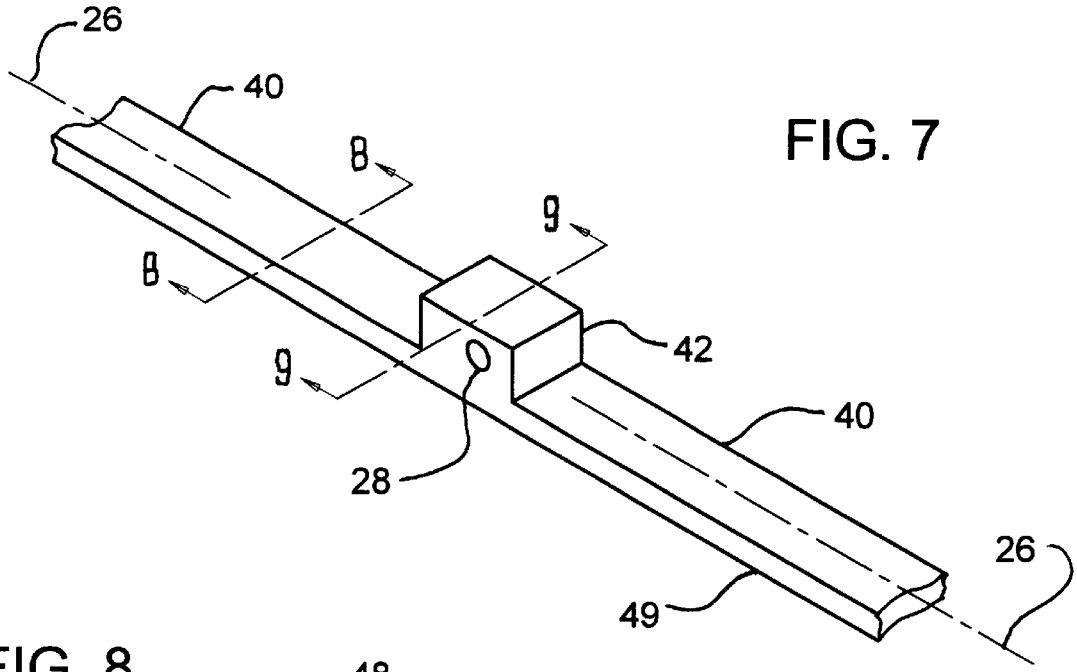
FIG. 7
FIG. 8
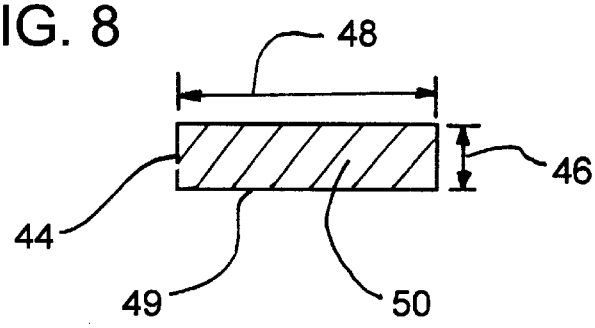
FIG. 9
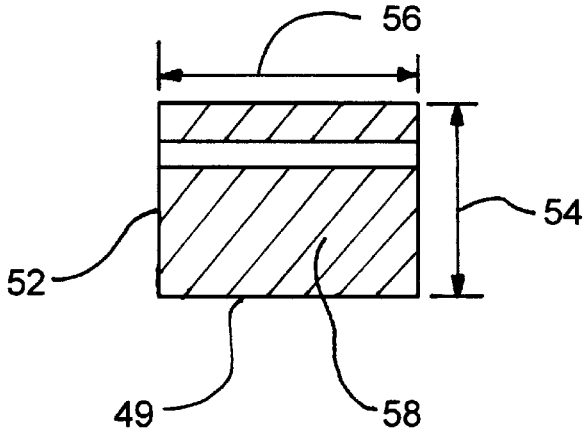

DEVICE FOR RELEASABLY ATTACHING AND STORING A FOCUSING STRAW ONTO AN AEROSOL CAN

FIELD OF THE INVENTION

The present invention relates to devices and methods used to store and releasably attach focusing straws onto aerosol cans.

BACKGROUND OF THE INVENTION

Aerosol spray-cans are widely used to contain and deliver various chemical agents. Some chemical agents, such as paint or hairspray, are commonly sprayed and applied onto a large surface area. Other chemicals, such as oils, lubricants or pesticides, are often applied onto a specific and small surface. For example, an aerosol oil often needs to be applied only onto frictional, mating surfaces and not onto surrounding surfaces. In the case of a compound miter saw for example, aerosol spray oil must be applied only to the sliding, rotating and frictional surfaces of the saw. Without the use of a focusing straw, oil is often "over-sprayed", resulting in contamination and damage to surrounding surfaces. Work-pieces are then often contaminated and damaged by the excessively sprayed oil. In addition, an excess amount of the aerosol is consumed and released as a contaminant into the environment.

Aerosol cans are packaged with a small "focusing straw" which can be temporarily adapted to the aerosol can nozzle. These straws provide a very effective means for focusing the aerosol onto specific, small surfaces, thereby reducing over-spray, related damages and excess use.

A focusing straw is often dislodged from a spray nozzle during handling or storage. Once removed from the spray nozzle and not properly stored, the focusing straw is easily misplaced or damaged. For example, a focusing straw misplaced in a toolbox often becomes unusable due to clogging with debris. Focusing straws are also rendered unusable due to bending or kinking. In addition, focusing straws are often sized to adapt to a specific aerosol can spray nozzle. Loose straws are therefor difficult to match to an appropriate aerosol can nozzle. Without an appropriate focusing straw, users often resort to wasteful and damaging over-spray.

In attempts to alleviate this problem, several means have been used to releasably attach a focusing straw to an aerosol can. A properly sized straw can then be removed from the can and inserted into the spray nozzle. After applying the aerosol, the straw can be reattached to the can, preserving it for future use. Examples of such releasable attachments include the use of pressure sensitive tape to secure a focusing straw onto an aerosol can. Once the focusing straw is removed from the aerosol can, reattachment with tape is often ineffective. The original pressure sensitive tape rapidly degrades and often, replacement tape is unavailable. Oil or other aerosol chemicals often degrade the tape and contaminate the can surface, preventing secure reattachment of the focusing straw.

Elastic bands have been used to releasably attach a focusing straw to an aerosol can. As with pressure sensitive tape, the elastic bands often degrade with chemical contact and break unpredictably, resulting in a misplaced or damaged focusing straw.

As a further illustration of the need for an improved focusing straw releasable attachment feature, a leading supplier of aerosol oil recently incorporated a releasable attachment feature into a cap of an aerosol can. This feature is designed to allow the releasable attachment of a focusing straw onto the cap of the aerosol can. As subsequently explained in further detail, the captured straw is oriented perpendicular to the can's longitudinal axis, aggravating the possibility of dislodgment during handling or storage. In addition, caps of aerosol cans are often lost or misplaced during use.

There is a need for a device and method of providing a reliable storage and releasable attachment of a focusing straw onto an aerosol can.

SUMMARY OF THE INVENTION

The present invention is a device and method for providing a reliable and simple means for the storage and releasable attachment of a focusing straw onto an aerosol can. The availability and subsequent use of a focusing straw often reduces aerosol over-spray and the resultant air borne contamination. In a preferred embodiment, the device is a commercially available cable-tie, modified to provide a releasable attachment and reliable storage of a focusing straw onto an aerosol can. A method of the present invention allows a user to modify an existing cable-tie to provide releasable attachment of a focusing straw onto an aerosol can or other item. Use of the present invention has, in some cases, reduced the consumption of aerosol spray oil by 30%.

BRIEF DESCRIPTION OF DRAWINGS

FIGS. 2A and 2B are isometric views of a prior art means of releasably attaching a focusing straw to an aerosol can using an elastic band.

FIG. 7 is an isometric view of a strap portion with a substantial protrusion having a through-hole adapted to provide a releasable attachment of a aerosol can focusing straw.

FIG. 8 is a cross-sectional view of a strap portion of FIG. 7.

FIG. 9 is a cross-sectional view of a substantial protrusion of FIG. 7.

DETAILED DESCRIPTION OF DRAWINGS

Figure 1A:
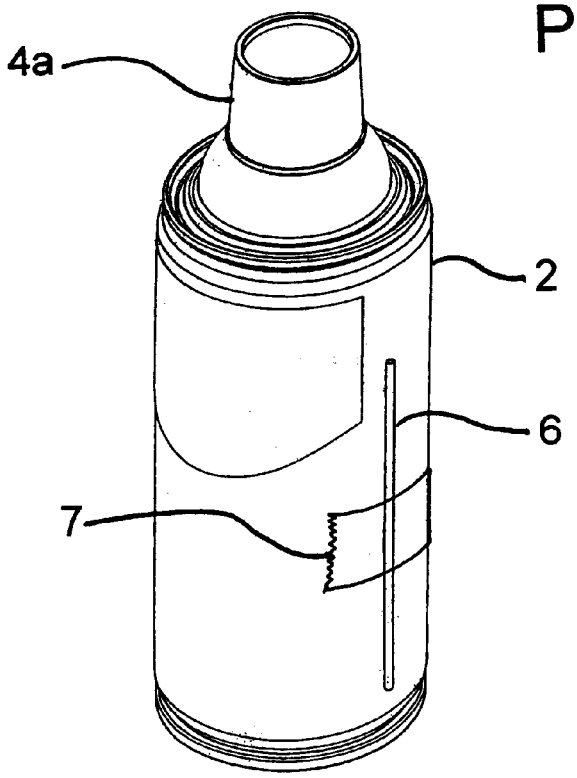
FIG. 1A Prior Art
FIGS. 1A and 1B are isometric views of a prior art means of releasably attaching a focusing straw to an aerosol can using pressure sensitive adhesive tape.
Figure 1B:
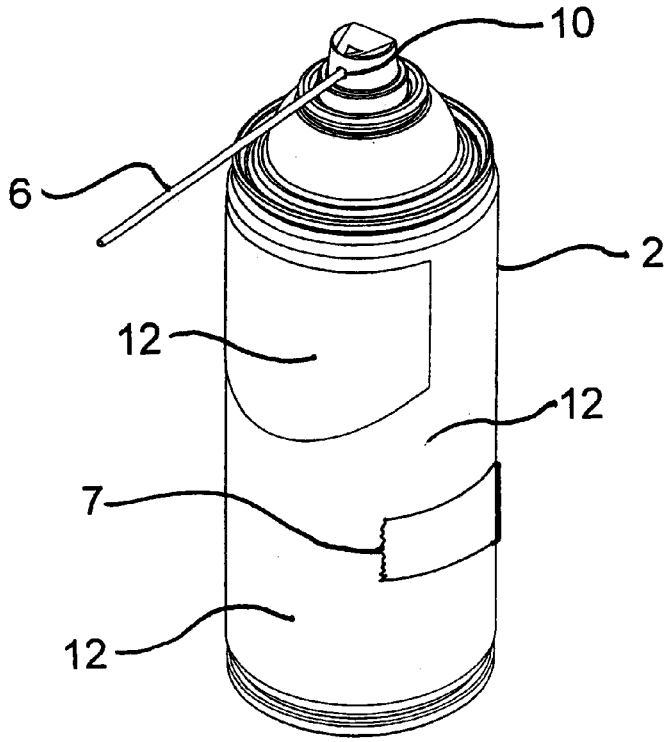
FIG. 1B Prior Art

FIGS. 1A and B are isometric views of a currently available aerosol spray can, having a focusing straw removably attached by a pressure sensitive tape. Shown in FIG. 1A is an aerosol can 2, having a cap 4*a* and a focusing straw 6 attached to the can with a segment of pressure sensitive tape 7. Shown in FIG. 1B is an aerosol spray can 2 with a focusing straw 6 removed from the tape 7 and secured into the spray nozzle 10. The original pressure sensitive tape 7 rapidly degrades and often, replacement tape is unavailable. Oil or other aerosol chemicals often degrade the tape 7 and contaminate the can surface 12, preventing secure reattachment of the focusing straw 6.

Shown in FIG. 2A is an aerosol can 2, having a cap 4*a* and a focusing straw 6 attached to the can with an elastic band 14. Shown in FIG. 2B is an aerosol spray can 2 with a focusing straw 6 removed from the elastic band 14 and secured into the spray nozzle 10. As with pressure sensitive tape, the elastic band 14 often degrades with chemical contact and breaks unpredictably, resulting in a misplaced or lost focusing straw 6.

Figure 3A:
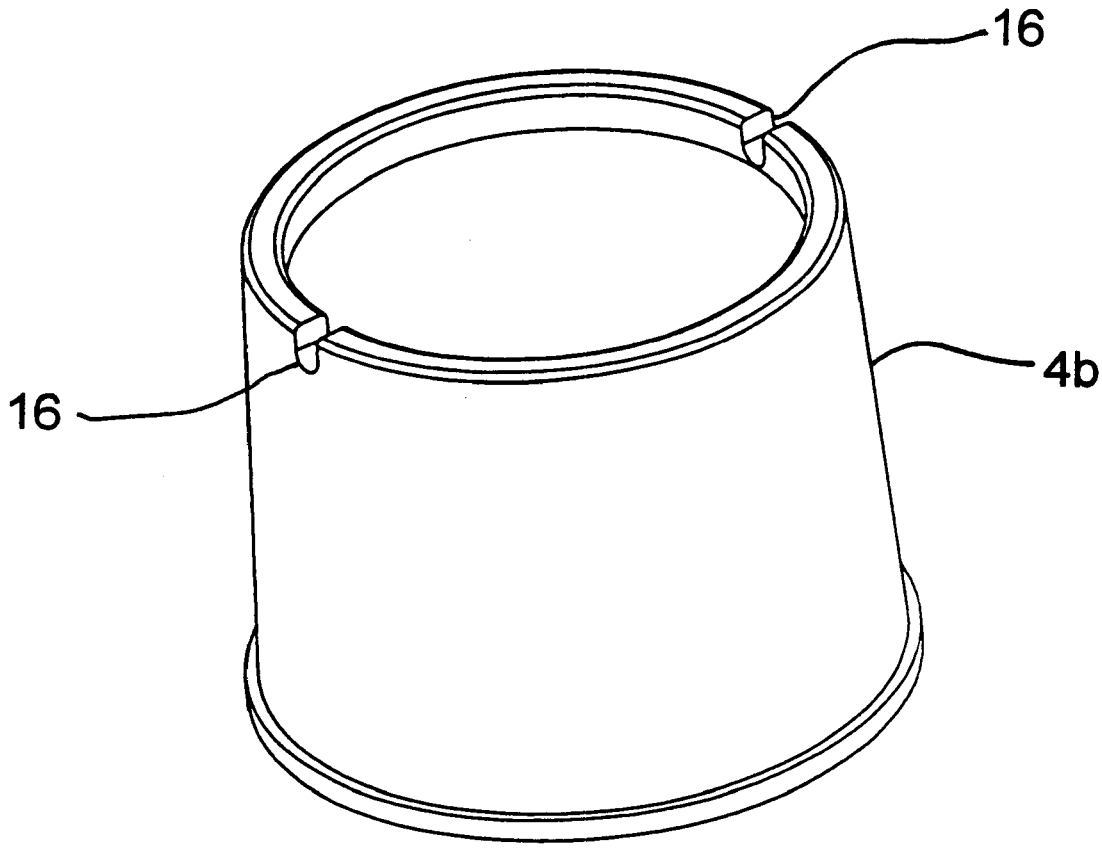
FIG. 3A Prior Art
FIGS. 3A and 3B are isometric views of a prior art means of releasably attaching a focusing straw to an aerosol can using a "snap-lock" feature integral to the aerosol can cap.
Figure 3B:
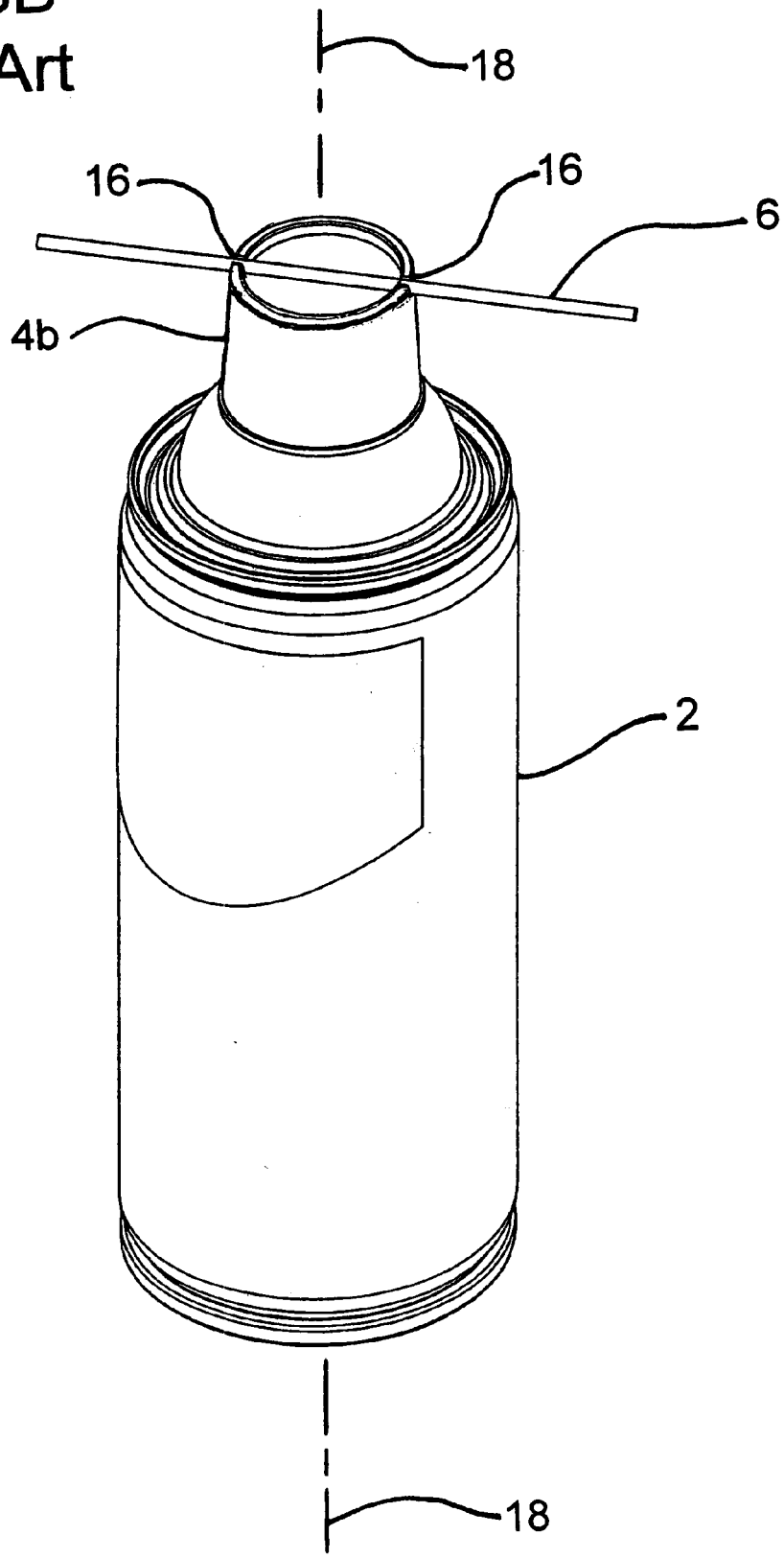
FIG. 3B Prior Art

Shown in FIG. 3A is an isometric view of a currently available aerosol spray can cap, having an integral releasable attachment feature. Shown is a cap 4*b,* with integral focusing straw capturing features 16. Shown in FIG. 3B is an aerosol spray can 2, with a cap 4*b* having integral focusing straw capturing features 16. A properly sized focusing straw 6 can be releasably attached to the capturing features 16. The straw therefore, is orientated essentially perpendicular to the cans longitudinal axis 18.

Figure 4A:
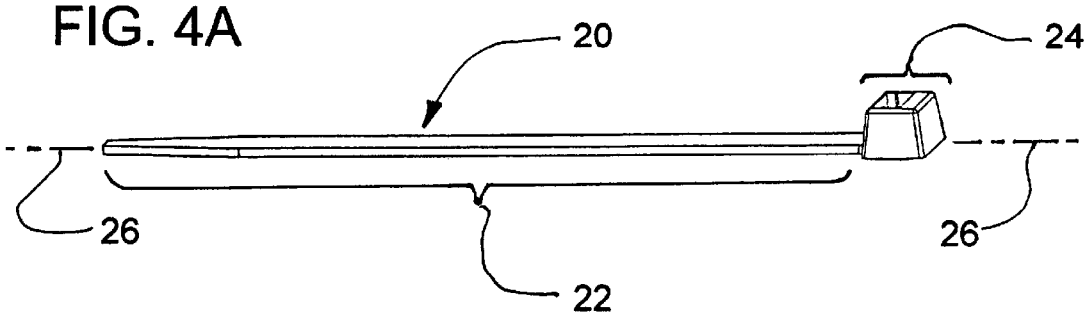
FIGS. 4A through 4C are isometric views of a cable-tie, with a through-hole modification according to the present invention, allowing the releasable attachment of a focusing straw onto an aerosol can.
Figure 4B:
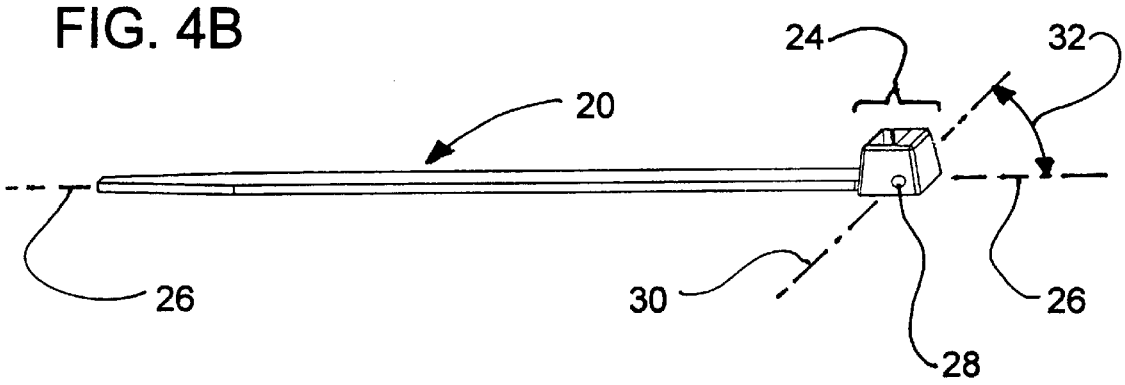
Figure 4C:
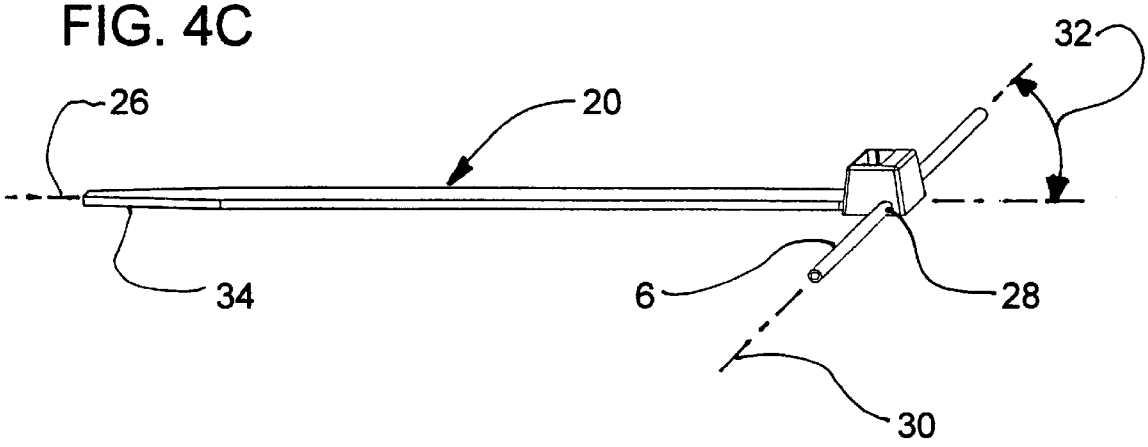
Figure 5:
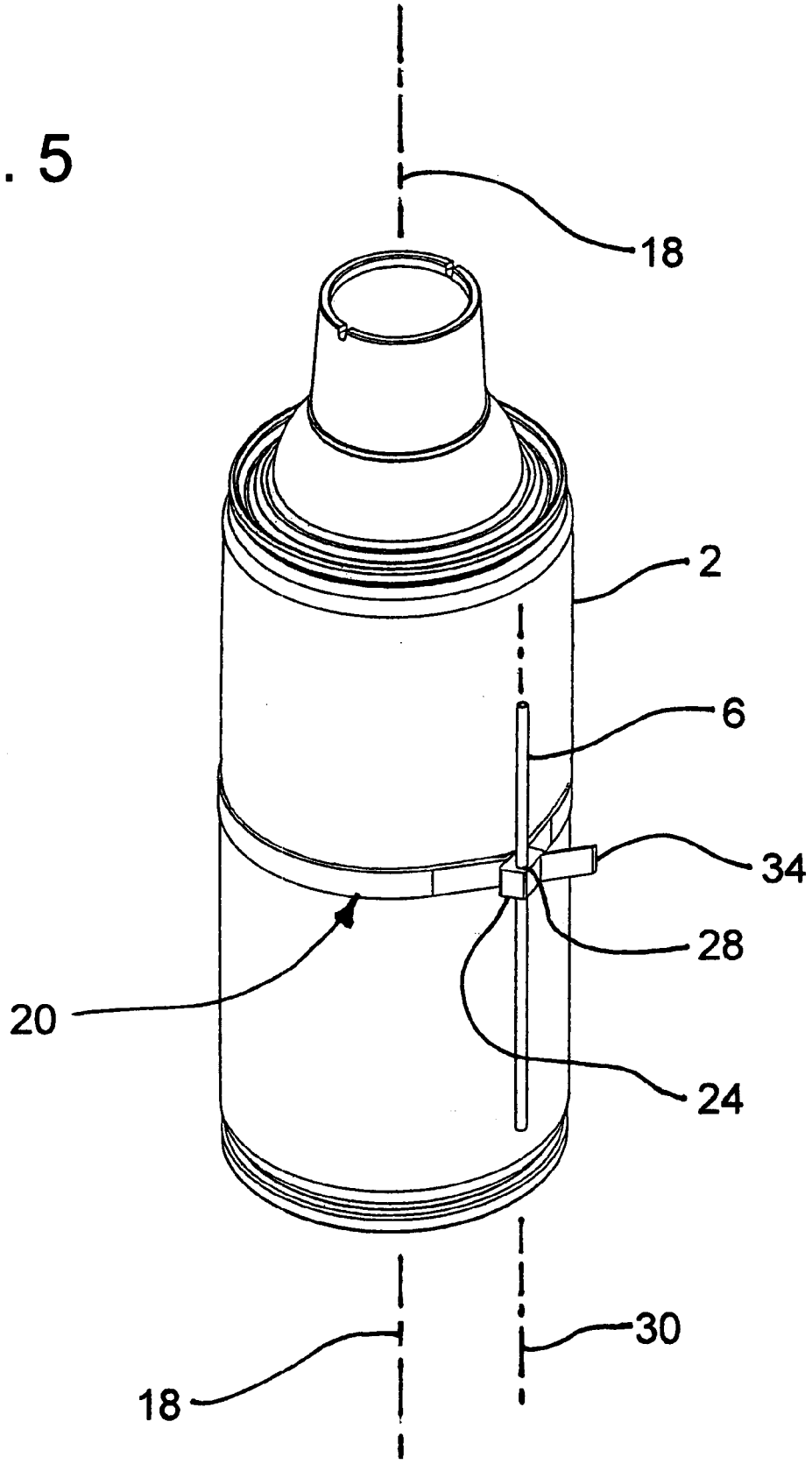
FIG. 5 is an isometric view of an aerosol can with an attached focusing straw and cable-tie of the present invention.

A preferred embodiment of the present invention is illustrated in FIGS. 4 through 5, all showing isometric views. FIG. 4A is a depiction of a commercially available cable-tie, prior to being modified according to the present invention. Shown is a cable-tie 20, having a flexible strap 22 with two opposing end portions, a self-locking mechanism 24 integral to one of the end portions and a longitudinal axis 26.

Shown in FIG. 4B is a cable tie 20, modified according to the present invention. Shown is a cable tie 20, having an integral locking mechanism portion 24. According to the present invention, a through-hole 28 has been added to the integral locking mechanism portion 24. The through-hole 28 has a longitudinal axis 30, oriented by angle 32 relative to the cable tie longitudinal axis 26. The through-hole 28 can be formed by any suitable means. In a preferred method, a commercially available cable-tie is examined to determine a suitable position for the through-hole. This position is then marked, by making a small indent onto the cable-tie with a sharp implement. The marked cable tie is then clamped into a vise and positioned onto a vertical drill press. An appropriately sized drill bit is then used to bore a vertical through-hole through the locking mechanism portion of the wire tie. An appropriate fixture can be utilized to rapidly drill precise through-holes into cable-tie locking mechanism portions. A hand drill can be used in lieu of a drill press. The through-hole can also be molded into the cable-tie at the time of manufacture.

As shown in FIG. 4C, a focusing straw 6 can be inserted into the through-hole 28. The focusing straw longitudinal axis 30 is oriented by angle 32 relative to the cable tie longitudinal axis 26. Also shown is a cable-tie strap end 34.

A cable-tie, modified according to the present invention, can be attached to an aerosol can as shown in FIG. 5. The cable-tie 20 is positioned around the can 2, the cable-tie strap end 34 is inserted into the locking mechanism portion 24 and the cable-tie is drawn tight and clinched around the aerosol can. The longitudinal axis 30 of the focusing straw 6 is oriented essentially parallel to the aerosol can longitudinal axis 18. If desired, the excess cable tie strap end 34 can be trimmed and removed.

Through hole 28 (FIGS. 4B, 4C and 5), provides a means for the storage and releasable attachment of a focusing straw. To have "a means for the storage and releasable attachment of a focusing straw", a through hole must be properly sized to allow multiple, tight slip-fit insertions and removals of a particular sized focusing straw. The through hole must also be positioned to avoid interference with a cable-tie locking mechanism. The longitudinal axis of the through-hole must also orient a focusing straw essentially parallel to the aerosol can longitudinal axis. These considerations, in concert, hereby define a through-hole, having "a means for the storage and releasable attachment of a focusing straw".

A through hole 28, providing a means for the storage and releasable attachment of a focusing straw, can be essentially circular and can have any diameter, which coincides with the diameter of a specific focusing straw. For example a through hole 28 can have a diameter of about 0.02" (0.05 mm), about 0.03" (0.8 mm), about 0.04" (1 mm), about 0.05" (1.3 mm), about 0.06" (1.6 mm), about 0.08" (2 mm), about 0.086" (2.2 mm), about 0.09" (2.3 mm), about (0.1" (2.5 mm) or about 0.13" (3.2 mm). A through hole, which provides a means for the storage and releasable attachment of a focusing straw, can have any suitable profile or shape. For example, a through hole can have a circular, triangle, square, star, oval, polygon, or other shape.

Figure 6:
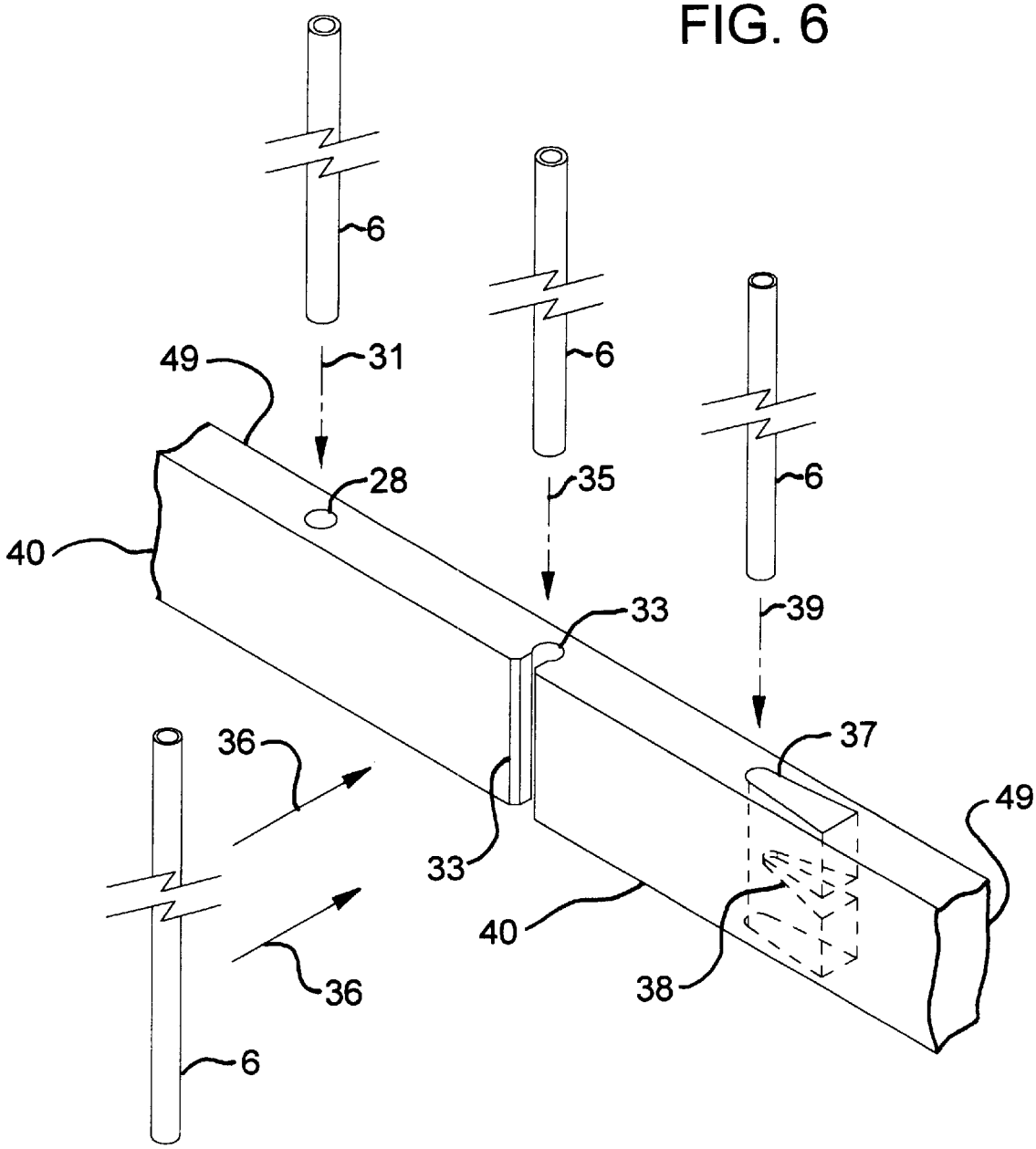
FIG. 6 is an isometric view showing alternate means for releasably attaching a focusing straw onto a flexible band or strap.

Shown in FIG. 6 are alternatives (to a through hole) which provide a means for the storage and releasable attachment of a focusing straw onto an aerosol can or other surface. Shown for comparison is a through hole 28 incorporated into a flexible strap or band segment 40. The band segment 40 has a contact surface 49 configured to allow contact onto, or attachment to, an aerosol can or other surface. For example the contact surface 49 may be attached to an aerosol can or other surface by an adhesive. A focusing straw 6 can be inserted along axis 31, into through hole 28. Through hole 28 is configured to provide a means for the storage and releasable attachment of the focusing straw.

Shown in FIG. 6 is a notch 33 incorporated into a band segment 40. A focusing straw 6 can be inserted into the notch along notch axis 35 in a manner similar to a through hole. A focusing straw can also be pressed into the notch 33 along axis 36. Notch 33 is properly dimensioned to allow multiple, tight slip-fit insertions and removals of a particular sized focusing straw. If incorporated into a cable-tie locking mechanism, the notch is positioned to avoid interference with the locking mechanism. The longitudinal axis 35 of the notch orients a focusing straw essentially parallel to the aerosol can longitudinal axis. Therefore, the notch 33 provides a means for the storage and releasable attachment of a focusing straw.

Also shown in FIG. 6 is a slot 37 incorporated into a band segment 40. Within the slot 37 is a feature designed to "capture" and releasably attach a focusing straw. Shown for an example, is a flexible member 38 positioned within the slot 37. When a focusing straw 6 is inserted along slot axis 39, the flexible member 38 is deflected and forced into contact with the focusing straw. The contact and friction between the slot 37, focusing straw 6 and flexible member 38 allows multiple, tight slip-fit insertions and removals of the focusing straw. If incorporated into a cable-tie locking mechanism, the slot is positioned to avoid interference with the locking mechanism. The longitudinal axis 39 of the slot orients a focusing straw essentially parallel to the aerosol can longitudinal axis. Therefore, the slot 37 provides a means for the storage and releasable attachment of a focusing straw. Alternatives to the flexible member 38 include and are not limited to, resilient protrusions or deformable surfaces within the slot. As depicted in FIG. 6, the slot 37 can be tapered or narrowed to capture and hold focusing straws of different diameters.

Shown in FIG. 7, is an alternate configuration of a device of the present invention, which provides a means for storing and releasably attaching a focusing straw onto an aerosol can or other surface. Shown are two partial band segments 40, a substantial protrusion 42 integral and connected to a band segment, a band segment longitudinal axis 26 and a through-hole 28, located within the substantial protrusion 42. The through hole is adapted to provide a means for the releasable attachment of an aerosol can focusing straw. A contact surface 49 is configured to allow contact onto, or attachment to, an aerosol can or other surface. For example the contact surface may be attached to an aerosol can or other surface by an adhesive. Also depicted are band segment cross-sectional plane 8 and a substantial protrusion cross-sectional plane 9.

Shown in FIG. 8 is a cross-sectional view of a band segment. The cross-section 44 has a projected height 46, a projected width 48, a contact surface 49 and a projected area 50. A "band" or "strap" is hereby defined as an element having a contact surface 49, configured to allow contact or attachment to an aerosol can or other surface and having a cross-sectional width 48 equal to at least the height 46.

Shown in FIG. 9 is a cross-sectional view of a substantial protrusion. The cross-section 52 has a projected height 54, a projected width 56, a contact surface 49 and a projected area 58. A "substantial protrusion" is hereby defined as an element integral to a band or strap, having a contact surface 49 configured to allow contact or attachment to an aerosol can or other surface and having a projected cross-sectional area 58 equal to at least 1.2 times the projected cross-sectional area 50 of a integral band or strap. Both cross-sectional areas 50, 58 are viewed "along" or essentially parallel to the band or strap longitudinal axis 26, as depicted by cross-sections 8 and 9.

Figure 10:
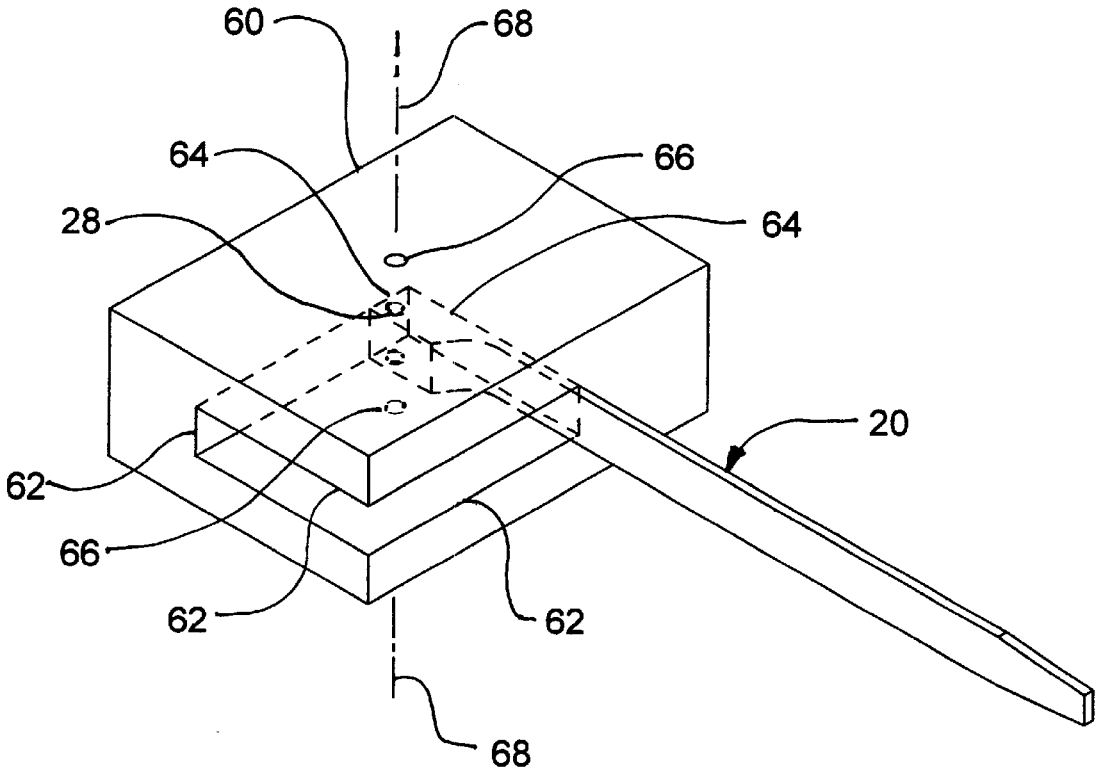
FIG. 10 is an isometric view of a fixture used to simplify the modification of a cable-tie according to the present invention.

Various fixtures can be utilized to simplify the modification of commercially available cable-ties according to the present invention. Shown in FIG. 10 is an example fixture 60, designed to simplify the modification of a specific (or other closely dimensioned) cable-tie according to the present invention. The fixture 60 has an alignment slot 62 dimensioned to allow the placement of a cable-tie 20 onto locating features 64. In this configuration, the locating features 64, are formed by the vertical sides of the alignment slot 62. Drill guide pilot bushings or holes 66 are incorporated into the fixture 60 and are positioned according to a specific (or other closely dimensioned) cable-tie. To modify a cable-tie according to the present invention, a properly sized cable-tie 20 can be inserted into the alignment slot 62 and held against the locating features 64. A properly sized drill can be inserted into one of the drill guide holes 66. A hole is then drilled along axis 68, resulting in a hole 28 through the cable-tie, which is adapted to provide a releasable attachment of a focusing straw.

A method of the present invention comprises the steps of:

a) providing a cable-tie having an integral self-locking portion;

b) forming a through hole into the self-locking portion; and c) inserting an aerosol can focusing straw into the through-hole.

A cable-tie or similar device, according to the present invention, may be supplied with an aerosol can along with a properly sized focusing straw. The cable-tie or similar device can be simply taped or banded onto an aerosol can, in a manner currently used to affix a focusing straw to the can. Multiple cable-ties or straps may be provided to allow attachment to large diameter containers.

Without intending to limit the present invention, the following example specifies how the present invention can be made and used.

EXAMPLE #1

A commercially available cable-tie was modified according to the present invention. The cable-tie was acquired from NAPA, part number BK.770-9220, Manufactured for BALKAMP, INC, Indianapolis, Ind. The cable-tie was comprised of nylon 6/6 and was approximately 14" (35 cm) long. A focusing straw having an outer diameter of about 0.085" (2.2 mm) was acquired with an 9.6 oz aerosol can of WD-40, available from The WD-40 Co. (San Diego, Calif.). A through-hole location was marked onto a first cable-tie self-locking portion using a sharp metal scribe. A narrow end segment of a second cable tie, about 4" long was inserted into the locking mechanism of the first cable tie, to facilitate clamping. The segment of the second cable-tie was inserted into a vise and used to pull the first cable tie down against the vice jaws. While being pulled down, the segment of the cable tie was clamped and secured. A hole was then drilled through the alignment mark on the self-locking portion of the first cable-tie using three passes of a 0.086" drill bit and an electric, variable speed drill motor. The drill motor was a MOTO-TOOL®, Model 395, Type 4, available from Dremel® (Racine, Wis.). A suitable collet was used to attach the drill bit. The through-hole was then de-burred and chamfered by hand using a sharp counter-sink to facilitate the insertion of the focusing straw. The cable-tie was then clamped around the aerosol can of WD-40 and the focusing straw was inserted into the through-hole, resulting in a device for releasably attaching and storing a focusing straw onto an aerosol can as shown in FIG. 5.

Figure 11A:
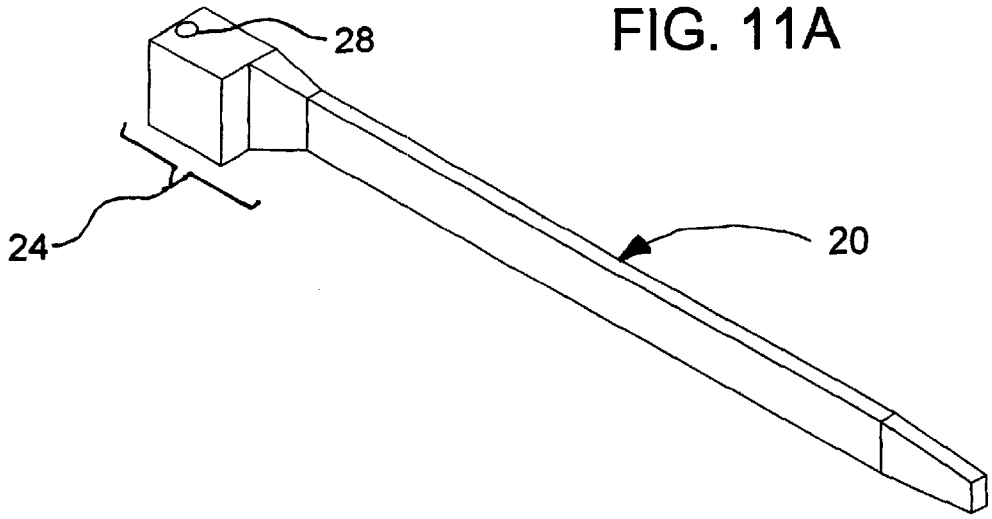
FIG. 11A is an isometric view of a cable-tie, with a through-hole modification according to Example 1, allowing the releasable attachment of a focusing straw onto an aerosol can.
Figure 11B:
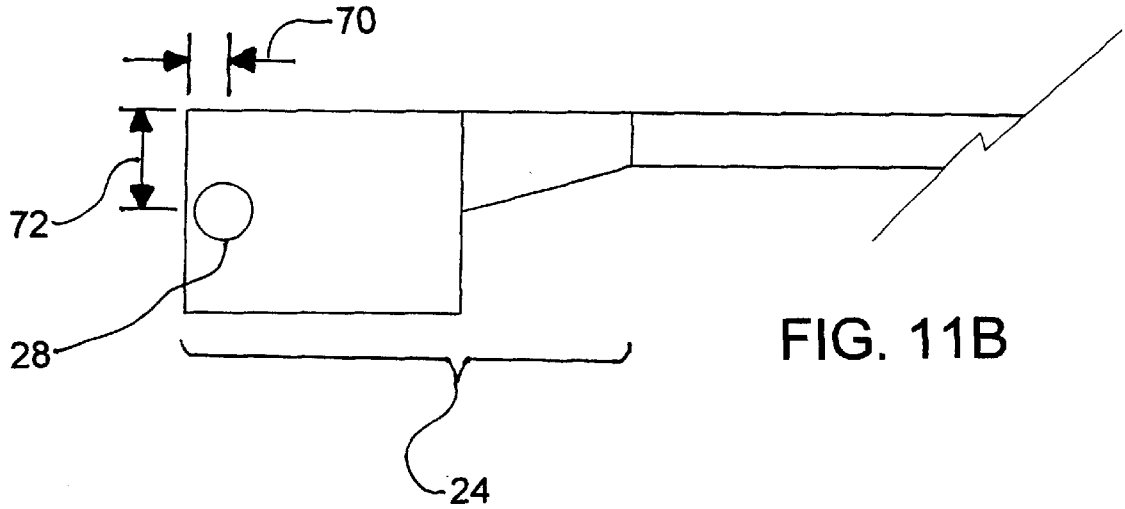
FIG. 11B is a partial top view of a cable-tie, with a through-hole modification, showing specific dimensions according to Example 1.

Shown in FIG. 11A is an isometric view of a cable tie 20 having a through-hole 28 within the self-locking portion 24. Shown in FIG. 11B, is a partial top view of the cable-tie self-locking mechanism 24, according to the present example. The approximate center of the circular shaped through hole is depicted in FIG. 11B. Dimension 70 was about 0.06" (1.5 mm) and dimension 72 was about 0.1" (2.5 mm).

Although the invention has been described in conjunction with specific embodiments, it is evident that many alterations and variations will be apparent to those skilled in the art in light of the foregoing descriptions and annexed drawings. Accordingly, the invention is intended to embrace all of the alternatives and variations that fall within the spirit and scope of the appended claims.

I claim:

1. A storage device for releasably attaching and storing a focusing straw onto an aerosol can, comprising:

a flexible strap having a first and a second end;

the first end having a strap configuration;

said strap configuration having a longitudinal axis, a cross-sectional width and a cross-sectional height defining a strap cross-sectional area as viewed along the longitudinal axis;

said strap cross-sectional width being equal to at least the strap cross-sectional height;

the second end having a single substantial protrusion configuration;

said substantial protrusion configuration having a longitudinal axis, a cross-sectional width and a cross-sectional height defining a substantial protrusion cross-sectional area as viewed along the longitudinal axis;

said substantial protrusion cross-sectional area being at least 1.2 times the first end strap cross-sectional area;

the substantial protrusion having a self locking mechanism configured to allow insertion of the elongate structure first end; and the substantial protrusion having a means to allow multiple tight slip-fit insertions and removals of the aerosol can focusing straw.

2. The storage device of claim 1 wherein the means to allow multiple tight slip-fit insertions and removals of the aerosol can focusing straw is provided by a through-hole.

3. The storage device of claim 2 wherein the through-hole has a diameter of between about 1.6 mm and 3.2 mm.

4. The storage device of claim 1 wherein the means to allow multiple tight slip-fit insertions and removals of the aerosol can focusing straw is provided by a notch.

5. The storage device of claim 1 wherein the means to allow multiple tight slip-fit insertions and removals of the aerosol can focusing straw is provided by a slot.

* * * * *